US006353416B1

(12) United States Patent
Hopkins et al.

(10) Patent No.: US 6,353,416 B1
(45) Date of Patent: Mar. 5, 2002

(54) DEVICE AND METHODS FOR TRANSMISSION OF ELECTROMAGNETIC ENERGY

(75) Inventors: Glenn D. Hopkins; Kerry P. Pullen, both of Marietta; Edward E. Weaver, deceased, late of Atlanta, by heir Catherine Weaver; Duane C. Tate, Marietta, all of GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 09/487,135

(22) Filed: Jan. 19, 2000

Related U.S. Application Data

(60) Provisional application No. 60/116,600, filed on Jan. 20, 1999.

(51) Int. Cl.[7] ..... H01P 5/107

(52) U.S. Cl. ..... 343/767; 333/26; 333/33

(58) Field of Search ..... 343/767, 785; 333/26, 33, 21 A

(56) References Cited

U.S. PATENT DOCUMENTS

| | | | | |
|---|---|---|---|---|
| 3,518,691 A | | 6/1970 | Hallendorff | 343/785 |
| 4,673,897 A | | 6/1987 | Chua et al. | 333/26 |
| 5,488,380 A | | 1/1996 | Harvey et al. | 342/368 |
| 5,600,286 A | | 2/1997 | Livingtston et al. | 333/26 |
| 5,812,032 A | * | 9/1998 | Stitzer | 333/24.1 |
| 6,100,853 A | * | 8/2000 | Schaffner et al. | 343/771 |

OTHER PUBLICATIONS

Bernd Schuppert, "Microstrip/Slotline Transitions: Modeling and Experimental Investigation", IEEE Transactions on Microwave Theroy and Techniques, vol. 36, No. 8, Aug. 1998, pp. 1272–1282.

Gupta et al., "Microstrip Lines and Slotlines", Artech, pp. 231–244.

Radmanesh et al., "Generalized Microstrip–Slotline Transitions: Theory and Simulation vs. Experiment," Microwave Journal, Jun. 1993, pp. 88, 90–95.

Seymour B. Cohn, "Slot Line on a Dielectric Substrate," IEEE Transactions on Microwave Theory and Techniques, vol. MTT–17, No. 10, Oct. 1969, pp. 768–777.

* cited by examiner

*Primary Examiner*—Tho Phan
*Assistant Examiner*—James Clinger
(74) *Attorney, Agent, or Firm*—Thomas, Kayden, Horstemeyer & Risley LLP

(57) ABSTRACT

Devices and methods for facilitating the delivery of EM energy between microstrip transmission lines and dielectric-filled waveguides are provided. In a preferred embodiment, a transition for transferring EM energy to and from a microstrip transmission line incorporates a longitudinally extending housing with a first end and a second end, and defining an interior therebetween. An element feed is disposed at least partially within the housing, with a first end of the element feed being configured to electrically communicate with the microstrip transmission line. Additionally, a dielectric material preferably surrounds at least a portion of the element feed and is disposed at least partially within the housing so that the housing and the dielectric material form a dielectric-filled waveguide. So configured, the transition is able to transmit EM energy between the microstrip transmission line and the dielectric-filled waveguide.

13 Claims, 10 Drawing Sheets

| Freq. (GHz) | Substrate (Inches) | Trace width (inches) | Offset from center (inches) | Length (inches) | Impedance (ohms) | β (rad/m) | α | λ (inches) |
|---|---|---|---|---|---|---|---|---|
| 10 | 0.025 | 0.0100 | 0.1125 | 0.2 | 67.95 | 513.4 | 0.51 | .0.482 |
| 10 | 0.025 | 0.0110 | 0.1125 | 0.2 | 65.84 | 513.4 | 0.51 | .0.482 |
| 10 | 0.025 | 0.0135 | 0.1125 | 0.2 | 61.25 | 513.4 | 0.51 | .0.482 |
| 10 | 0.025 | 0.0115 | 0.1125 | 0.2 | 64.86 | 513.4 | 0.51 | .0.482 |
| 10 | 0.025 | 0.0125 | 0.1125 | 0.2 | 65.74 | 513.4 | 0.51 | .0.482 |
| 10 | 0.025 | 0.0175 | 0.1125 | 0.2 | 57.58 | 513.4 | 0.51 | .0.482 |
| 10 | 0.025 | 0.0250 | 0.1125 | 0.2 | 48.90 | 513.4 | 0.51 | .0.482 |
| 10 | 0.025 | 0.0250 | 0.1125 | 0.15 | 49.00 | 513.4 | 0.51 | .0.482 |

Fig. 9

| freq. (GHz) | slot width (inches) | length (inches) | bulb diameter (inches) | Port Description | Impedance (ohms) | b (rad/m) | a | λ (inches) |
|---|---|---|---|---|---|---|---|---|
| 10.0 | 0.0040 | 0.1834 | 0.1834 | Slotline in gnd. Plane | 51.31 | 495.04 | 0.53 | 0.500 |
| | | | | Wg with gnd plane | | 335.0 | 0.79 | 0.738 |
| 10.0 | 0.0098 | 0.4000 | 0.08 | Slotline in gnd. Plane | 6.31 | 489.73 | 0.54 | 0.505 |
| | | | | Wg with gnd plane | | 335.0 | 0.79 | 0.738 |
| 8.0 | 0.0015 | 0.1000 | NA | Wg & fin | 39.6 | 393.0 | 0.43 | 0.629 |
| 10.0 | 0.0015 | 0.1000 | NA | Wg & fin | 29.25 | 499.3 | 0.53 | 0.495 |
| 10.0 | 0.0030 | 0.1000 | NA | Wg & fin | 47.5 | 496.4 | 0.53 | 0.498 |
| 10.0 | 0.0050 | 0.2000 | NA | Wg & fin | 54.62 | 493.9 | 0.53 | 0.501 |
| 10.0 | 0.0070 | 0.2000 | NA | Wg & fin | 60.06 | 492.0 | 0.54 | 0.503 |
| 10.0 | 0.0360 | 0.2000 | NA | Wg & fin | 106.25 | 475.6 | 0.55 | 0.520 |
| 10.0 | 0.0240 | 0.2000 | NA | Wg & fin | 89.94 | 481.4 | 0.55 | 0.514 |
| 10.0 | 0.0480 | 0.2000 | NA | Wg & fin | 121.79 | 470.1 | 0.56 | 0.526 |
| 10.0 | 0.0240 | 0.2000 | NA | Wg. fin, & air gap 0.0007" | 90.40 | 476.1 | 0.54 | 0.520 |
| 10.0 | 0.0480 | 0.2000 | NA | Wg. fin, & air gap 0.0007" | 121.79 | 466.3 | 0.56 | 0.530 |
| 10.0 | 0.0090 | 0.2000 | NA | Wg. fin, & air gap 0.0007" | 65.40 | 481.4 | 0.53 | 0.514 |
| 10.0 | 0.0106 | 0.2000 | NA | Wg & fin | 68.65 | 481.0 | 0.53 | 0.514 |
| 10.0 | 0.0082 | 0.2000 | NA | Wg & fin | 64.08 | 481.5 | 0.52 | 0.514 |
| 10.0 | 0.0098 | | NA | Wg & fin | 66.44 | 489.3 | | 0.506 |

Fig. 11

| freq. (GHz) | substrate (mils) | | width (mils) | length (in.) | termination type | term. dimension (mils) | X-over dist. (mils) | | Return Loss (dB) | VSWR (X:1) | | X-M loss (dB) | Impedance (ohms) | β (rad/m) | λ (inches) |
|---|---|---|---|---|---|---|---|---|---|---|---|---|---|---|---|
| 10 | 25 | strip | 10.5 | .3 | Qtr. wave stub | 113.797 | 10.500 | 0.3239 | -9.8 | 2.0 | 0.9461 | -.0.5 | 66.7 | 513.4 | 0.482 |
| | | slot | 9.8 | | Bulb | 120 | | | | | | | 66.6 | 489.3 | 0.506 |
| 10 | 15 | strip | 6.5 | .3 | Qtr. wave stub | 113.797 | 10.500 | 0.1805 | -14.9 | 1.4 | 0.9836 | -0.1 | 66.1 | 513.4 | 0.482 |
| | | slot | 9.8 | | Bulb | 80 | | | | | | | 66.5 | 489.3 | 0.506 |
| 10 | 15 | strip | 15.0 | .3 | Qtr. wave stub | 113.8 | 10.500 | 0.0216 | -33.3 | 1.0 | 0.9998 | 0.0 | 48.5 | 513.4 | 0.482 |
| | | slot | 9.8 | | Bulb | 80 | | | | | | | 2 66.5 | 489.3 | 0.506 |
| 6 | 15 | strip | 15.0 | .3 | Qtr. wave stub | 113.8 | 10.500 | 0.0966 | -20.3 | 1.2 | 0.9953 | 0.0 | 48.5 | 308.0 | 0.803 |
| | | slot | 9.8 | | Bulb | 80 | | | | | | | 1 73.39 | 266.0 | 0.930 |
| 7.6 | 15 | strip | 15.0 | .3 | Qtr. wave stub | 113.8 | 10.500 | 0.0356 | -29.0 | 1.1 | 0.9994 | 0.0 | 48.5 | 390.2 | 0.634 |
| | | slot | 9.8 | | Bulb | 80 | | | | | | | 2 69.10 | 357.9 | 0.691 |
| 9.2 | 15 | strip | 15.0 | .3 | Qtr. wave stub | 113.8 | 10.500 | 0.0405 | -27.9 | 1.1 | 0.9992 | 0.0 | 48.5 | 472.3 | 0.524 |
| | | slot | 9.8 | | Bulb | 80 | | | | | | | 2 67.13 | 446.1 | 0.555 |
| 10.8 | 15 | strip | 15.0 | .3 | Qtr. wave stub | 113.8 | 10.500 | 0.0728 | -22.8 | 1.2 | 0.9973 | 0.0 | 48.5 | 554.5 | 0.446 |
| | | slot | 9.8 | | Bulb | 80 | | | | | | | 1 66.04 | 532.0.26 | 0.465 |
| 12.4 | 15 | strip | 15.0 | .3 | Qtr. wave stub | 113.8 | 10.500 | 0.2166 | -13.3 | 1.6 | 0.9763 | -0.2 | 48.5 | 636.6 | 0.389 |
| | | slot | 9.8 | | Bulb | 80 | | | | | | | 2 65.38 | 617.4 | 0.401 |
| 14.0 | 15 | strip | 15.0 | .3 | Qtr. wave stub | 113.8 | 10.500 | 0.4475 | -7.0 | 2.6 | 0.8873 | -1.0 | 48.5 | 718.7 | 0.344 |
| | | slot | 9.8 | | Bulb | 80 | | | | | | | 2 64.94 | 701.8 | 0.352 |

DEVICE AND METHODS FOR TRANSMISSION OF ELECTROMAGNETIC ENERGY

CROSS REFERENCE TO RELATED APPLICATIONS

This application is based on and claims priority to U.S. Provision Application Serial No. 60/116,600, filed Jan. 20, 1999, and which is incorporated by reference herein in its entirety.

STATEMENT REGARDING FEDERALLY SPONSORED RESEARCH AND DEVELOPMENT

The U. S. Government has a paid-up license in this invention and the right in limited circumstances to require the patent owner to license others on reasonable terms as provided for by the terms of U.S. Navy Contract No. N61331-95-K-0009.

BACKGROUND OF THE INVENTION

1. Field of the Invention

The present invention relates generally to devices and methods for the transmission of electromagnetic (EM) energy and, in particular, to transitions for facilitating the delivery of EM energy between microstrip transmission lines and dielectric-filled waveguides.

2. Description of the Related Art

A transition is an assembly which is configured to facilitate the transfer of electromagnetic (EM) energy between various electrical transmission lines. For example, an antenna may incorporate a transition which facilitates the transfer of field energy between a radiator and the various transmit/receive (T/R) modules of the antenna, among others. As such, transition design is a critical component of antenna construction, for instance, because the transition typically is required to match the field modal structure of the waveguide of the radiator with those components of the antenna which interconnect the radiator with the T/R modules.

Typically, waveguides have, heretofore, been designed in an air-filled configuration, and thus, the prior art contains much literature on transitions which are suited for such uses. However, the use of an air-filled waveguide is not practical in all applications, such as when a dielectric-filled waveguide may be more appropriate, for instance. In such applications, use of typical prior art transitions may not provide suitable performance. Specifically, typical prior art transitions seem to be particularly unsuitable for use in facilitating the transfer of electromagnetic (EM) energy between a microstrip and a dielectric-filled waveguide, for example.

Therefore, there is a need for improved devices and methods which address these and other shortcomings of the prior art.

SUMMARY OF THE INVENTION

Briefly stated, the present invention relates generally to devices and methods for facilitating the delivery of EM energy between microstrip transmission lines and dielectric-filled waveguides. In a preferred embodiment, a transition for transferring PM energy to and from a microstrip transmission line is provided which incorporates a longitudinally extending housing with a first end and a second end, and defining an interior therebetween. An element feed is disposed at least partially within the housing, with a first end of the element feed being configured to electrically communicate with the microstrip transmission line. Additionally, a dielectric material preferably surrounds at least a portion of the element feed and is disposed at least partially within the housing so that the housing and the dielectric material form a dielectric-filled waveguide. So configured, the transition is able to transmit EM energy between the microstrip transmission line and the dielectric-filled waveguide.

In accordance with another aspect of the present invention, an antenna for transmitting and receiving EM energy is provided. Preferably, the antenna incorporates a housing with a microstrip transmission line being arranged adjacent thereto. An element feed is disposed at least partially within the housing, with a first end of the element feed being configured to electrically communicate with the microstrip transmission line. Additionally, a dielectric material preferably surrounds at least a portion of the element feed and is disposed at least partially within the housing so that the housing and the dielectric material form a dielectric-filled waveguide. So configured, the antenna is adapted to transmit EM energy between the microstrip transmission line and the dielectric-filled waveguide.

In accordance with another aspect of the present invention, an antenna array for transmitting/receiving electromagnetic (EM) is provided. In a preferred embodiment, the array incorporates a base and a plurality of antennas mounted to said base. Preferably each of the antennas include: (1) a housing; (2) an element feed disposed at least partially within the housing, and; (3) a dielectric material surrounding at least a portion of the element feed and disposed at least partially within the housing so that the housing and the dielectric material form a dielectric-filled waveguide. Thus, each element feed is configured to transmit EM energy between a microstrip transmission line and its dielectric-filled waveguide.

In accordance with still another aspect of the present invention, a method for transmitting EM energy between a microstrip transmission line and a dielectric-filled waveguide is provided. Preferably, the method includes the steps of: (1) providing a first transition and a pseudo-stripline transmission line, the first transition being configured to transmit EM energy between the microstrip transmission line and the pseudo-stripline transmission line; (2) providing a second transition and a pseudo-slotline transmission line, the second transition being configured to transmit EM energy between the pseudo-stripline transmission line and the pseudo-slotline transmission line, and; (3) providing a third transition configured to transmit EM energy between the pseudo-slotline transmission line and the dielectric-filled waveguide.

In accordance with yet another aspect of the present invention, a method for forming a dielectric-filled waveguide is provided. Preferably, the method includes the steps of: (1) providing a longitudinally extending housing having a longitudinal axis and defining an interior; (2) providing a first dielectric material member; (3) providing a second dielectric material member; (4) providing an element feed, and; (5) arranging the first dielectric material member, the second dielectric material and the element feed at least partially within the interior of the housing such that the element feed is disposed between the first dielectric material member and the second dielectric material member, the element feed being arranged along the longitudinal axis of the housing.

Other features and advantages of the present invention will become apparent to one of reasonable skill in the art upon examination of the following drawings and detailed description. It is intended that all such additional objects, features, and advantages be included herein within the scope of the present invention, as defined by the claims.

BRIEF DESCRIPTION OF THE SEVERAL VIEWS OF THE DRAWINGS

The present invention will be more fully understood from the accompanying drawings of various embodiments of the invention which, however, should not be taken to limit the invention to the specific embodiments enumerated, but are for explanation and for better understanding only. Furthermore, the drawings are not necessarily to scale, emphasis instead being placed upon clearly illustrating the principles of the invention. In the drawings:

FIG. 9 depicts tabular data correlating architectural parameters of the pseudo-slotline with corresponding electrical propagation and impedance values.

FIG. 11 depicts tabular data relating pseudo-stripline to pseudo-slotline transition models.

DETAILED DESCRIPTION OF A PREFERRED EMBODIMENT

Figure 1:
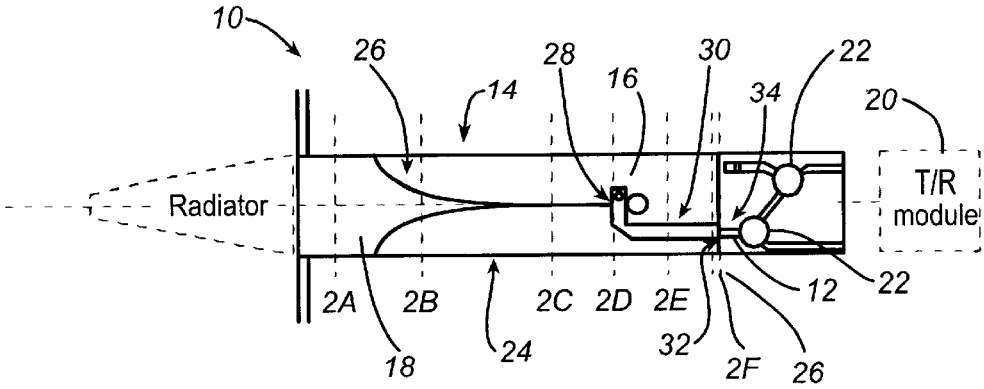
FIG. 1 is a schematic diagram depicting a preferred embodiment of the present invention.

Reference will now be made in detail to the description of the invention as illustrated in the drawings, wherein like reference numbers indicate like parts throughout the several views. As shown in FIG. 1, the preferred embodiment of the microstrip to dielectric-filled waveguide transition 10 (referred to hereinafter as "transition 10") of the present invention provides a simple and elegant solution to the electrical design problems associated with transitioning between microstrip 12 and waveguide 14. As described in greater detail hereinafter, the present invention provides electrical performance suitable for applications throughout the UHF and microwave frequency bands, as well as extending well into the millimeter-wave frequency bands. It should be noted that the preferred embodiment of the present invention described herein meets the following design criteria (although adherence to the following criteria is not required for the purpose of practicing the present invention): 10 GHz center operating frequency; at least 10% (1 GHz) bandwidth; linear polarization; supports an antenna goal of less than 1 dB transmission loss through the antenna (window to element to feed, and vise versa), and; operation at high transmit power levels of 10–20 watts per element. Specifically, the present invention is scalable, both up and down, as is readily apparent to one of ordinary skill in the art.

As depicted in FIG. 1, the transition 10 of the present invention includes an element feed 16 which preferably is embedded in dielectric material 18. Such a dielectric material may include various ceramics, i.e., fiberglass-loaded ceramics, for instance, thermoplastic, PTFE, as well as other materials which possess acceptable loss tangents.

Preferably, waveguide 14 is configured as a longitudinally extending member or housing and, preferably, incorporates a cylindrical shape, although various other configurations, such as waveguides with rectangular cross-sections, for instance, may be utilized depending upon the particular application. For those transitions 10 incorporated into systems, such as radar systems, for example, input to the feeds 16 typically are provided by transmit/receive (T/R) modules 20. Circulators 22 also may be provided, which are adapted to protect the T/R modules on transmit and direct spurious energy to a resistive load (not shown).

Figure 2A:
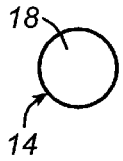
FIGS. 2A–2G are representative cross-sectional views of the embodiment depicted in FIG. 1.
Figure 2B:
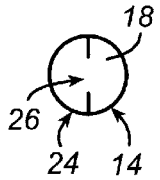
Figure 2C:
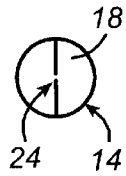
Figure 2D:
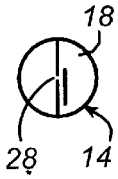
Figure 2E:
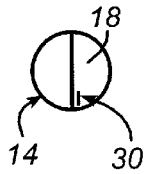
Figure 2F:
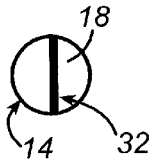
Figure 2G:
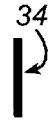

As depicted in FIGS. 2A–2G, representative cross-sections of various element feed transitions and transmission lines are depicted. As depicted therein, FIG. 2A illustrates a transmission line comprising dielectric-filled waveguide 14; FIGS. 2B and 2C illustrate a transition 24, (referred to hereinafter as "pseudo-slotline"); FIG. 2D illustrates a transition 28, (referred to hereinafter as "pseudo-slotline to pseudo-stripline"); FIG. 2E illustrates a transmission line 30, (referred to hereinafter as "pseudo-stripline"); FIG. 2F illustrates a transition 32, (referred to hereinafter as "pseudo-stripline to microstrip"), and; FIG. 2G illustrates a transmission line 34, (referred to hereinafter as "microstrip").

Figure 3:
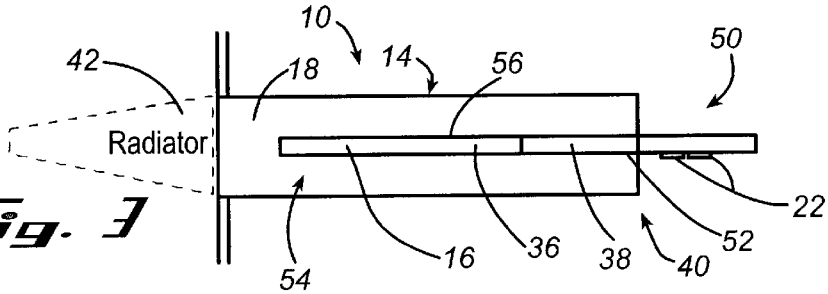
FIG. 3 is a schematic diagram depicting a top view of the embodiment shown in FIG. 1.
Figure 4:
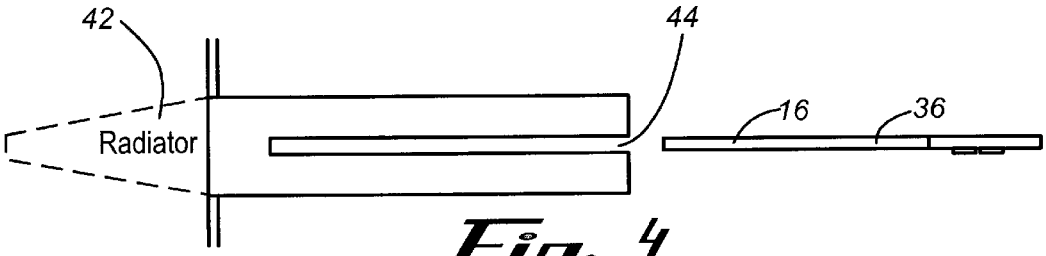
FIG. 4 is a partially-exploded, schematic diagram of the embodiment depicted in FIGS. 1–3, with the circuit card removed from the dielectric material.

As depicted in FIGS. 3 and 4, the feed 16 preferably is configured as a printed circuit card 36 which is adapted to end feed the waveguide 14 with a single, linear lead polarized signal. The card 36 may be manufactured by etching traces on a dielectric substrate 38, such as by using a processes similar to that of standard printed circuit board fabrication, for instance. So configured, the feed 16 provides the various transitions required from the microstrip to the dielectric-filled waveguide. Additionally, as described in detail hereinafter, a slot 44 may be configured within the dielectric material 18 for ease of manufacture so that the feed 16 may be conveniently inserted into the waveguide.

Preferably, a first end 50 of the card 36 incorporates a microstrip trace 52 on one side that provides a transition, such as to the circulators 22, in an open environment. The second end 54 of the card preferably is etched, such as on the ground plane side 56 of the card, to flare smoothly to the edges of the waveguide, thereby providing a good transition between the card and the dielectric-filled waveguide. Additionally, preferably two other transitions are utilized on the card (as described in detail hereinafter): (1) from the pure microstrip on the substrate in air to the waveguide enclosed pseudo-stripline trace beginning where the card enters the waveguide, and; (2) from the pseudo-stripline to the pseudo-slotline that serves as a transmission line to the flare of the pseudo-slotline.

As shown in FIGS. 3 and 4, the transition 10 may be utilized as an antenna 40 which may include a radiator 42 formed at a distal end of the antenna for propagating the EM energy from the waveguide.

Transition from Pseudo-Stripline to Pseudo-Slotline

The transition 28 required coupling the energy of the EM wave from the pseudo-stripline 30 into the pseudo-slotline 26. Preferably, the flare 26 of the pseudo-slotline 24 and pseudo-slotline 24 are centered in the waveguide, with the pseudo-stripline preferably crossing the pseudo-slotline orthogonally. As shown in FIG. 1, for instance, this dictated that the pseudo-stripline be offset from the waveguide center, i.e., longitudinal axis, and include a 90° bend to cross the pseudo-slotline. While going across the waveguide, the distance between the pseudo-stripline trace and the upper surface of the waveguide varies, changing the electrical characteristics of the pseudo-stripline. Specifically, the impedance of the pseudo-stripline changes with the variation in height of the upper waveguide wall from the pseudo-stripline trace.

Modeling

Since a printed circuit feed used in conjunction with a solid, dielectric-filled waveguide would not lend itself to reasonable turnaround times for hardware cut-and-try design and development trials, a packaged software simulation program was used to generate and refine the basic design. The package used was the Hewlett-Packard High Frequency Structure Simulator (HFSS). The HFSS allows development of a workable design without the repetitive machining, assembly, and measurement stages associated with hardware cut and-try design testing. These stages are replaced with a design drawing input to the software simulator, analysis of the output from the simulation, modification of the design, and re-simulation.

The HFSS uses a finite element approach to solve Maxwell's equations for multiple tetrahedra within the stricture to be simulated. An iterative solution process is used to adapt the solution from one iteration to smaller tetrahedra for the next iteration, until the user-set convergence criteria are met for the desired model accuracy.

Transmission Lines

Figure 5:
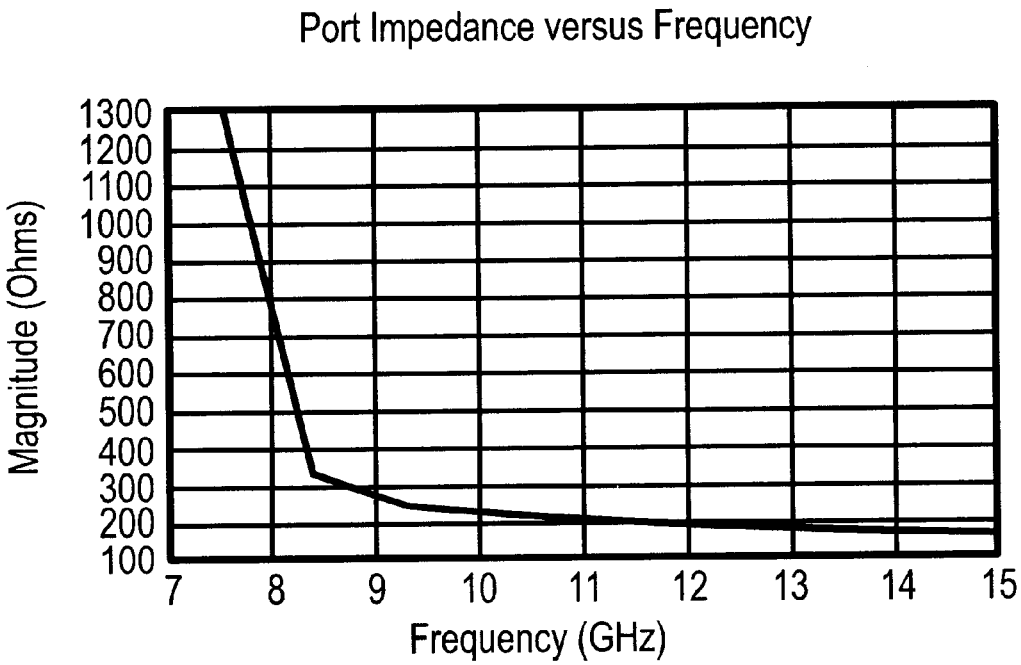
FIG. 5 is a graph depicting port impedance versus frequency of a preferred embodiment of the present invention.
Figure 6:
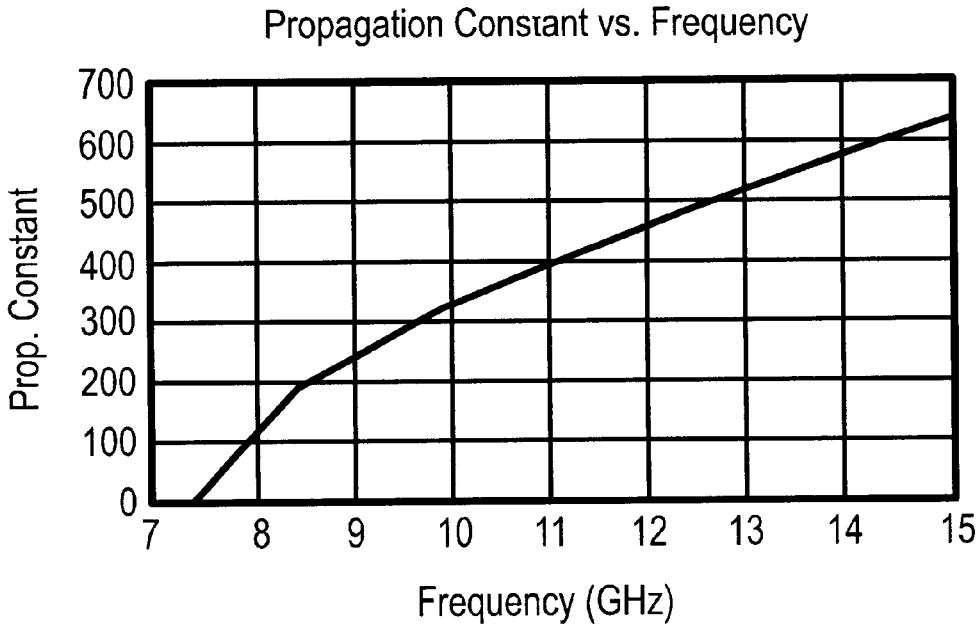
FIG. 6 is a graph depicting propagation constant versus frequency of a preferred embodiment of the present invention.

The HFSS design began by modeling the individual transmission lines in the mediums that would be used for the final element, to the extent that these had been determined. This included dielectric-filled circular waveguide, the pseudo-slotline, the pseudo-stripline, and the microstrip. FIGS. 5 and 6 show the model-predicted impedance and propagation constant, respectively, as a function of frequency, for the 0.375 diameter circular waveguide loaded with dielectric with $\epsilon_r$=6.0. The figures show that the cutoff frequency for this configuration is 7.5 GHz, and the impedance near the design center frequency (10 GHz) is approximately 221 ohms.

Figures 7, 8:
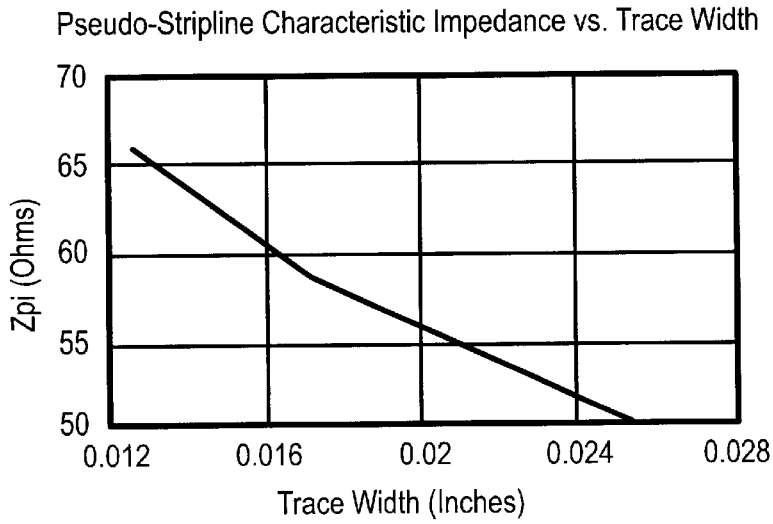
FIG. 7 depicts tabular data correlating architectural parameters of the pseudo-stripline with corresponding electrical propagation and impedance values.
FIG. 8 is a graph depicting pseudo-stripline characteristic impedance versus trace width.

Next to be modeled was the pseudo-stripline transmission line for the section between the microstrip and the pseudo-slotline transmission line sections. FIG. 7 shows some results of numerous pseudo-stripline configurations modeled. FIG. 8 shows the variation of the pseudo-stripline impedance with line width for the selected waveguide and dielectric.

Figure 10:
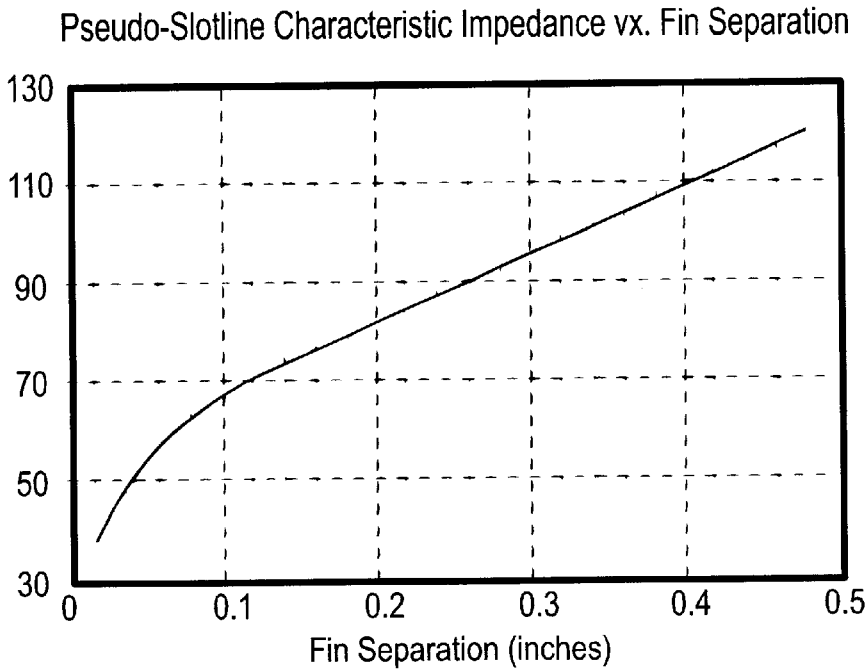
FIG. 10 is a graph depicting pseudo-slotline characteristic impedance versus fin separation.

Likewise, the characteristics of the pseudo-slotline transmission line section were determined using HFSS modeling. FIG. 9 gives the results from some of the configurations modeled, using different gap widths for the pseudo-slotline and FIG. 10 shows the changes of the pseudo-slotline impedance as a function of the gap width.

Pseudo-Stripline to Pseudo-Slotline Transition

At the beginning of the feed design, one of the major objectives was to reduce the reflections from the transmission line transitions in order to reduce the radar cross-section. As noted earlier, the transition that was expected to be the largest problem, in this respect, was the transition from pseudo-stripline to pseudo-slotline, where both are embedded in the dielectric-filled waveguide. Based on the results of the transmission line models, an impedance value of approximately 67 ohms was selected for both of the transmission lines. This value matched the two impedances while maintaining line widths that would be manufacturable. Given these resulting line widths as the starting point, the analysis effort turned to finding a good RF coupling technique between the two transmission line types. Initial considerations included: (1) the pseudo-slotline would be centered in the circular waveguide due to the fact that the transition to the radiating element needed to be symmetric; (2) the pseudo-slotline would be etched into the ground plane of the pseudo-stripline substrate; (3) the pseudo-stripline would be offset from center and would have to include a turn to be perpendicular to the pseudo-slotline at the coupling point, (4) the relative dielectric constant of the substrate would be picked to match that of the dielectric filling the waveguide to reduce discontinuities to a minimum, and (5) an initial substrate thickness of 0.025" was selected as a conveniently available standard that would be relatively easy to work within manufacturing and assembly stages.

Goals were to couple as much RF energy as possible, while maintaining a VSWR of 1.5:1 or less. A ten percent bandwidth was desired, but it was preferable to achieve a significantly wider bandwidth, if possible. The wide bandwidth parameter was to be at least considered during the early design. Parameters that might impact the quality of the transition included: (1) the impedance of the coupling transition region itself (an assumption had been that matching the impedances of the two transmission lines was the best starting point); (2) the excitation of modes that would not couple into the transmission lines and which would propagate in the wrong direction; (3) changes in the impedance and propagation characteristics of the energy in the crossguide section of the pseudo-stripline; (4) the exact line lengths of the quarter-wave stubs due to end effects in the dielectric-filled waveguide; (5) optimum diameters of the respective "bulbs" for the best energy transfer and widest bandwidth; (6) placement of the cross-over point relative to the beginning of the "bulbs"; (7) effect of the substrate thickness, and (8) placement of the pseudo-stripline between the curving or arcuate waveguide wall and the pseudo-slotline termination (either stub or bulb).

This number of variables, which are not independent, lead to a design that meets specified requirements, but which has not been optimized in all aspects. Parameters of the design were changed in a systematic manner, but when one parameter was changed that substantially changed the performance, there was not a redesign effort to optimize all the other parameters; the program schedule precluded such an intensive evaluation. Specifically, the transmission line impedances were matched at approximately 67 ohms each on a substrate that was 25 mils thick. With these parameters fixed, numerous variations of the pseudo-stripline placement, pseudo-stripline termination, pseudo-slotline termination, and relative cross-over positions were modeled.

After considerable effort with these parameters, the transition performance had been improved, but was still significantly below specification. Using the best of these designs, the substrate thickness was reduced from 25 mils to 15 mils. This change resulted in significant improvement in the transition's performance. As an additional change, the characteristic impedance of the pseudo-stripline section was changed from the 67 ohms that matched the pseudo-slotline back to the standard 50 ohm value that would match its transition back to the microgtrip section. This change also greatly improved the performance of the pseudo-stripline to pseudo-slotline transition. These two final changes resulted in a transition that exceeded the desired performance.

FIG. 11 presents some of the various configurations and their performance that were tried prior to the final two changes. While the trends observed with the changes made may be helpful in optimizing a design, the changes presented are not necessarily directly applicable to the final transition since the substrate thickness and the pseudostripline impedance (and therefore width) are not the same. This same design approach can be applied to all the transitions.

Pseudo-Slotline to Waveguide Transition

A pseudo-slotline flare was selected for the transition from the pseudo-slotline to the dielectric-filled waveguide. The effort devoted to this transition was to determine the shape of the flare, its overall length, and the length of the pseudo-slotline required between the beginning of the flare and the pseudo-slotline-to-pseudo-stripline transition. The width of the initial section of pseudo-slotline had been fixed by the previous transition to pseudo-stripline. The length of the pseudo-slotline section from the pseudo-stripline transition to the start of the flare was chosen to be slightly over one-quarter wavelength so that reactive modes set up at either transition would die out prior to reaching the next transition, although various other configurations may be utilized. The pseudo-slotline and the flare, and therefore, the ground plane of the substrate, preferably would be centered in the waveguide to maintain symmetry for the radiating element.

Several mathematical functions were considered to generate the loci of points for the flare transition. These included exponential flares of different lengths, doubly curved circular functions, and finally, functions based on maintaining a constant change of impedance per unit length of the flare. Models of the flare were run with flare lengths varying from 0.5 to 1.5 inches. The best results were achieved when the flare was based on a constant change of impedance along its length. As can be observed in FIG. 10, the impedance of the pseudo-slotline varies as the width of the cap. The impedance value for the pseudo-slotline width at the transition to pseudo-stripline is approximately 67 ohms while the value for the 0.375" dielectric-filled waveguide is approximately 221 ohms. A polynomial was fit to the change of impedance as a function of gap width, then the flare (pseudo-slotline gap width) was defined such that there was a constant change of impedance along the flare. The modeling results also indicated that the best performance was achieved when the flare to the waveguide walls was made slowly, requiring a longer section for the transition. As a conservative approach for this proof of concept design, a flare length of 1.5 inches was selected.

Pseudo-Stripline to Microstrip Transition

The final transition to be designed was that from pseudo-stripline to microstrip at the feed end of the waveguide. This transition was between two 50 ohm transmission lines. The width of the pseudo-stripline trace was 0.015" and that of the microstrip trace was 0.0218". A straight taper between these two dimensions, centered on the waveguide interface, was selected. This configuration was modeled as the first design. Predicted performance of this design was better than a VGWR of 1. 12:1 across the frequency hand of interest.

Complete Feed Model

Figure 12:
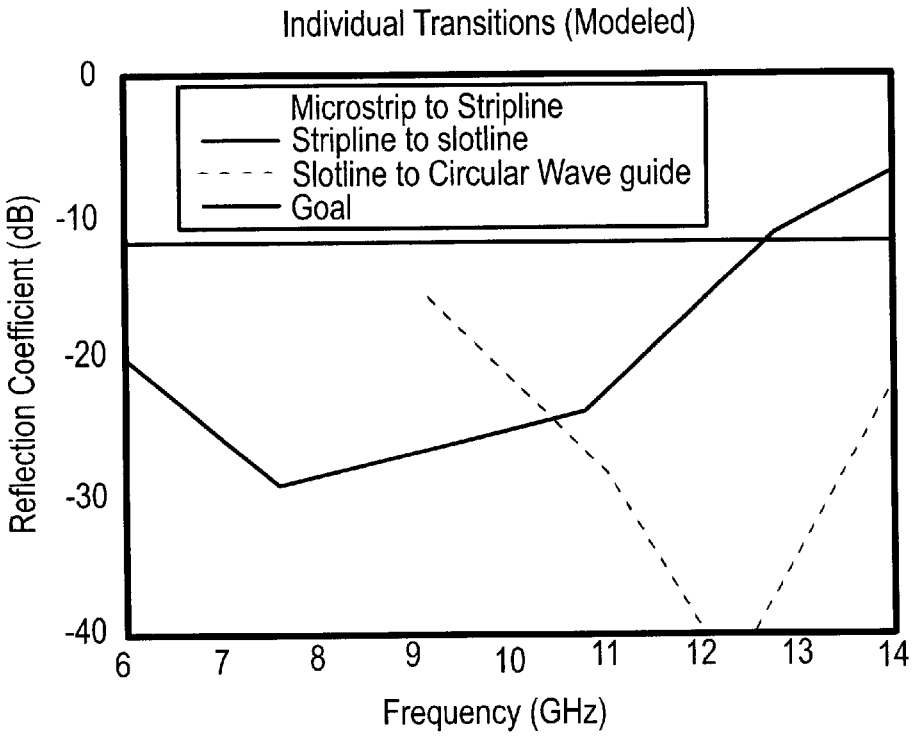
FIG. 12 is a graph depicting reflection coefficient versus frequency for various modeled transitions.
Figure 13A:
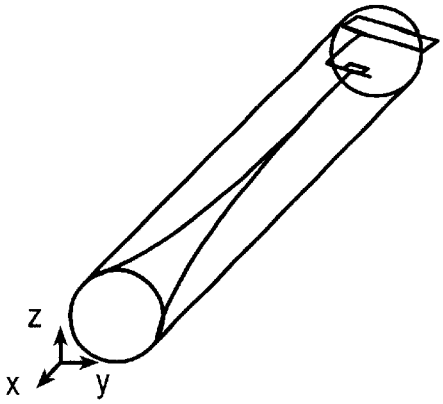
FIG. 13A is graphic depiction of a modeled feed which was utilized to validate principles of an embodiment of the present invention.
Figure 13C:
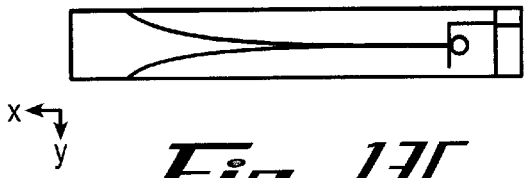
FIG. 13C is a top view of the model feed depicted in FIGS. 13A and 13B.
Figure 13D:
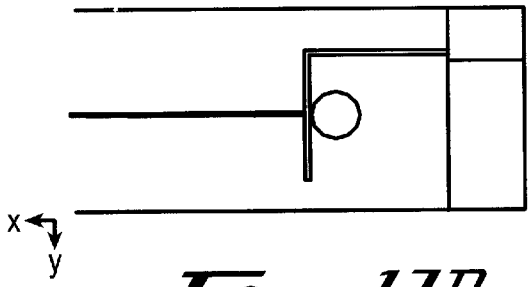
FIG. 13D is a partially cut-away, magnified view of the embodiment depicted in FIGS. 13A–13C.
Figure 13B:
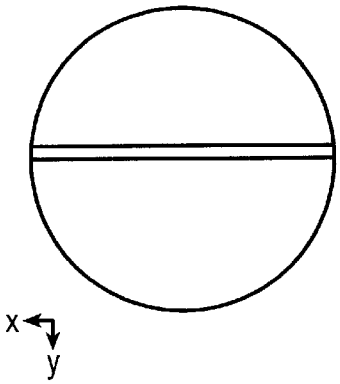
FIG. 13B is an end view of the model feed depicted in FIG. 13A.
Figure 14:
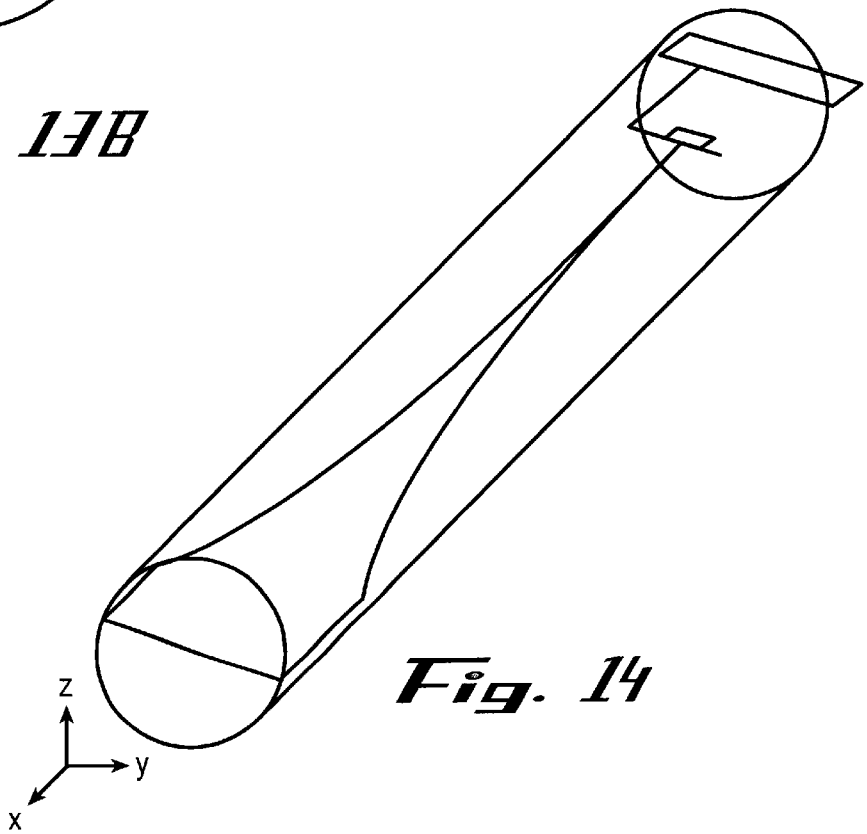
FIG. 14 illustrates simulated EM flow through the model feed of FIGS. 13A–13D.
Figure 15:
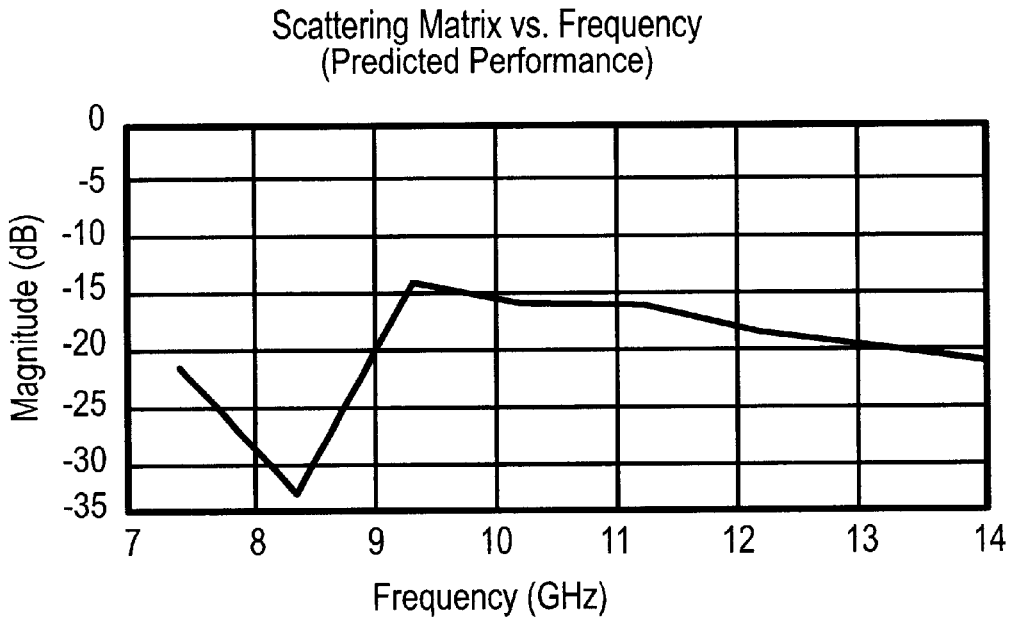
FIG. 15 is a graph depicting scattering matrix versus frequency of a preferred embodiment of the present invention (predicted performance).

Using the frequency sweep capability of the HFSS, the performance of the individual transitions was predicted across a wide frequency band. These results were then compared to the performance goal for the entire feed. FIG. 12 shows the predicted performance for each transition alone with the project coal. As shown in the FIG. 12, the project goal was being met over the frequency range of interest by each of the transitions. The next step in the design process was to put all the transmission lines and transitions together to determine how the combination would operate as a complete feed assembly. FIGS. 13A–13D show the line drawings that were used for the complete feed model. FIG. 14 shows the simulated flow of the EM fields through the feed and into the dielectric-filled waveguide. Predicted return loss for the feed is shown in FIG. 15. Based on these results, it was decided to produce a hardware version of the printed circuit feed card for testing.

Hardware Testing

The material selected for the substrate was Rogers Corporation TMM-6, 0.015" thick and plated with 0.5 ounce copper, although various other materials and dimensions may be utilized depending upon the particular application. The selected material has a relative dielectric constant of 6 and a loss tangent of 0.0018. Based on the standard sizes of the printed circuit board substrate material, the overall size of the feed, and the nature of the printed circuit board production, it was convenient to layout a drawing that would result in the production of 44 of the printed circuit feeds. Four versions of the feed design were included in the layout and procured for the hardware testing. Two types of traces were manufactured, one as described above and one with an extra delay section in the microstrip transmission line and two associated right angle bends. Ten of the 44 feeds had truncated ground plane edges that would not contact the waveguide walls for hardware verification of the poor performance predicted by the HFSS model when the feed ground plane did not contact the waveguide wall.

To test the performance of the feeds, a test fixture was designed and constructed. This fixture consisted of brass tubing with an inside diameter of 0.375" loaded with Emerson & Cuming Stycast HiK dielectric rod with a relative dielectric constant of 6 and a loss tangent of 0.002. This dummy element (tubing and dielectric) was slotted at each end, such that a printed circuit feed could be inserted into the slot at each end. A special test fixture support was fabricated to hold the test element and to support a coaxial connection to the exposed microstrip section of the printed circuit feed. The S-parameter measurements could then be made with the two identical feeds facing each other in the dummy element waveguide, using an HP 8510 vector network analyzer. One concern of the test configuration was the possibility of radiation from the slots in the dummy element. The test jig was made such that aluminum blocks screwed down tightly around the circular waveguide in the regions that contained the slots.

Figure 16:
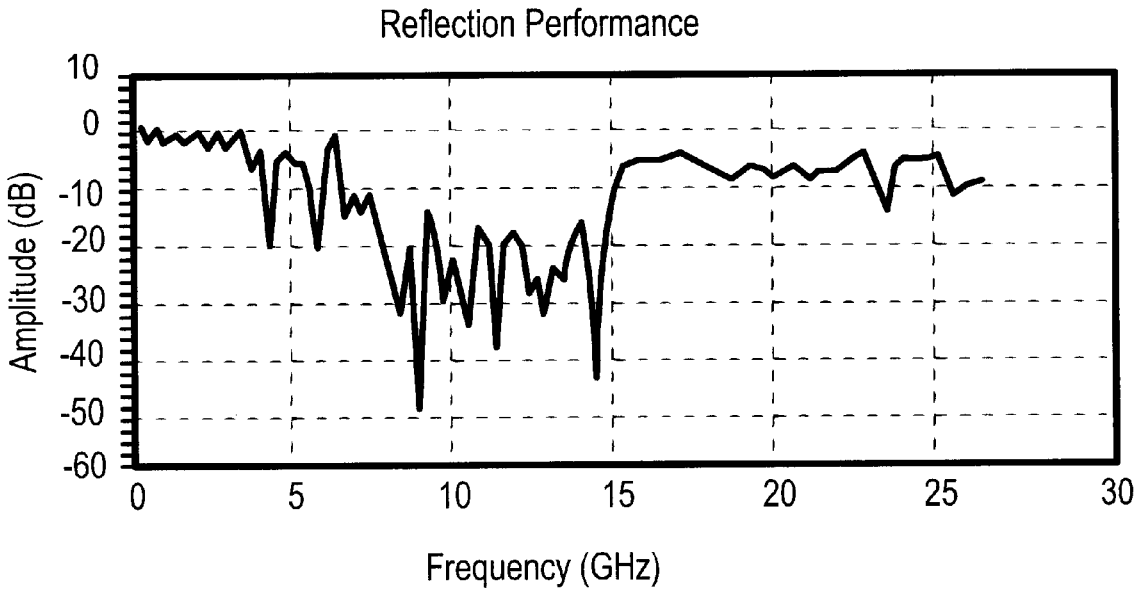
FIG. 16 is a graph depicting reflection performance versus frequency of a preferred embodiment of the present invention.
Figure 17:
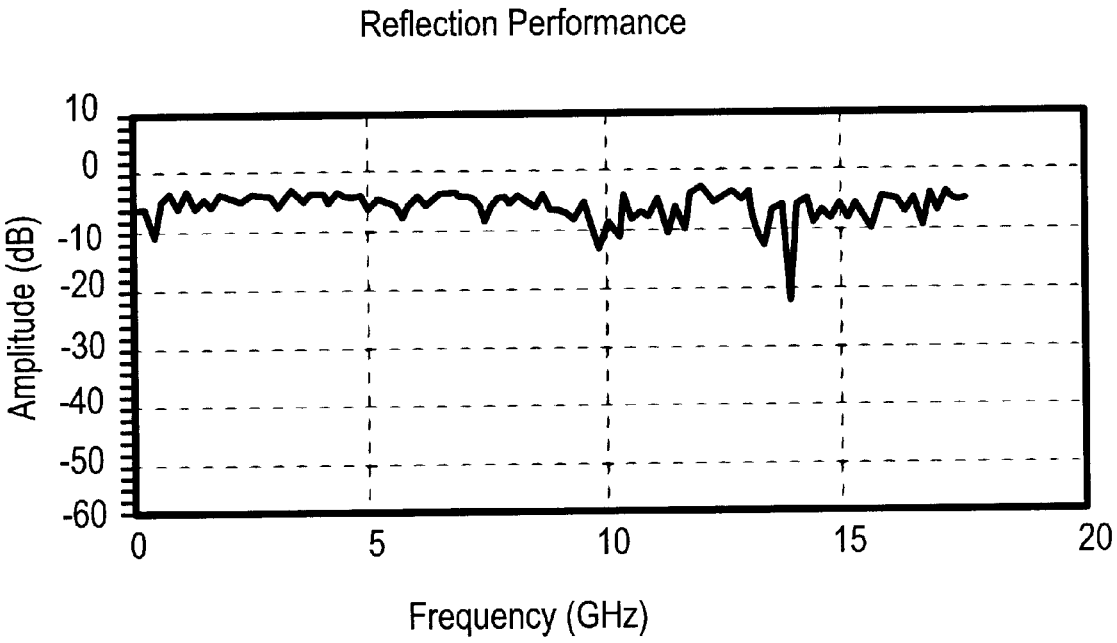
FIG. 17 is graph depicting reflection performance versus frequency of an alternative embodiment of the present invention.

FIGS. 16 and 17 show typical results for the reflection performance of the printed circuit feed cards. FIG. 16 shows the reflection measurement of a single feed card (with ground plane contacting the waveguide wall). This plot shows that the feed's performance significantly exceeds the goal of −14 dB return loss through most of the frequency band of interest. FIG. 17 is the return loss measurement of the non-contacting feed and it verifies the HFSS prediction that this version is unworkable.

Figure 18:
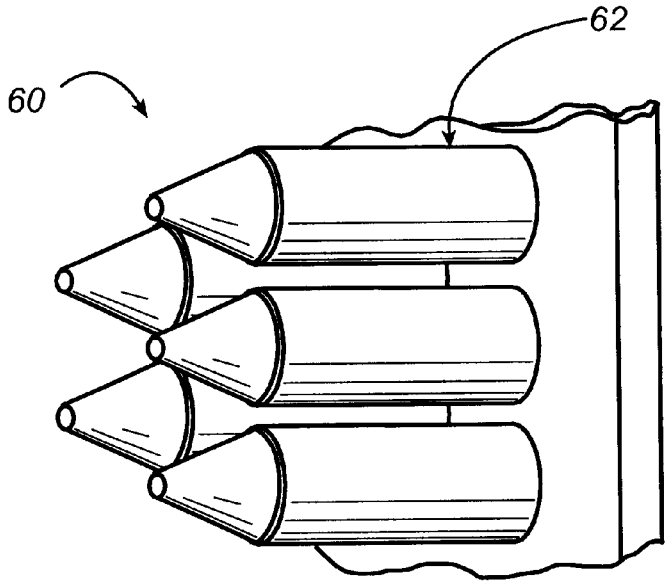
FIG. 18 is a partially cut-away, perspective view of a preferred embodiment of the present invention shown incorporated into a representative antenna array.
Figure 19:
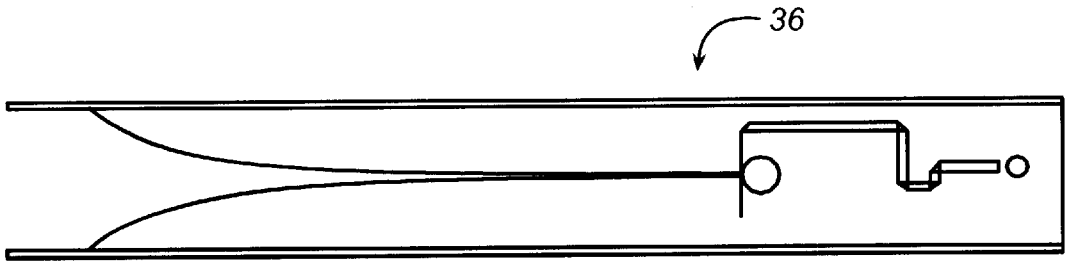
FIG. 19 is a schematic diagram depicting a preferred embodiment of the feed of the present invention.
Figure 20:
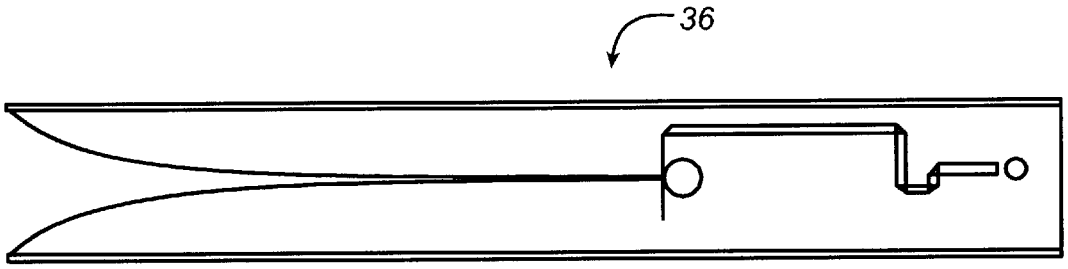
FIG. 20 is a schematic diagram depicting an alternative embodiment of the feed of the present invention.

Following the verification of the performance of the prototype printed circuit feed card, a final pair of feed cards were designed for testing in a 90 element array (i.e., array 60 of FIG. 18), although arrays of various numbers of elements 62 may be utilized in a typical application. These two card designs are shown in FIGS. 19 and 20. Since the 90 element test array would have only a few elements that were actively fed, the feed cards were also designed such that a resistive load (not shown) could be mounted between the microstrip output and the ground plane using a plated-through "via" hole (not shown). The elements that were not actively fed would be terminated in this manner to reduce reflections during the tests. For the active elements, the resistor mounting gap and "via" portion of the card would be removed and a support structure and coaxial connector attached to the microstrip as was done with the prototype feed cards.

Figure 21:
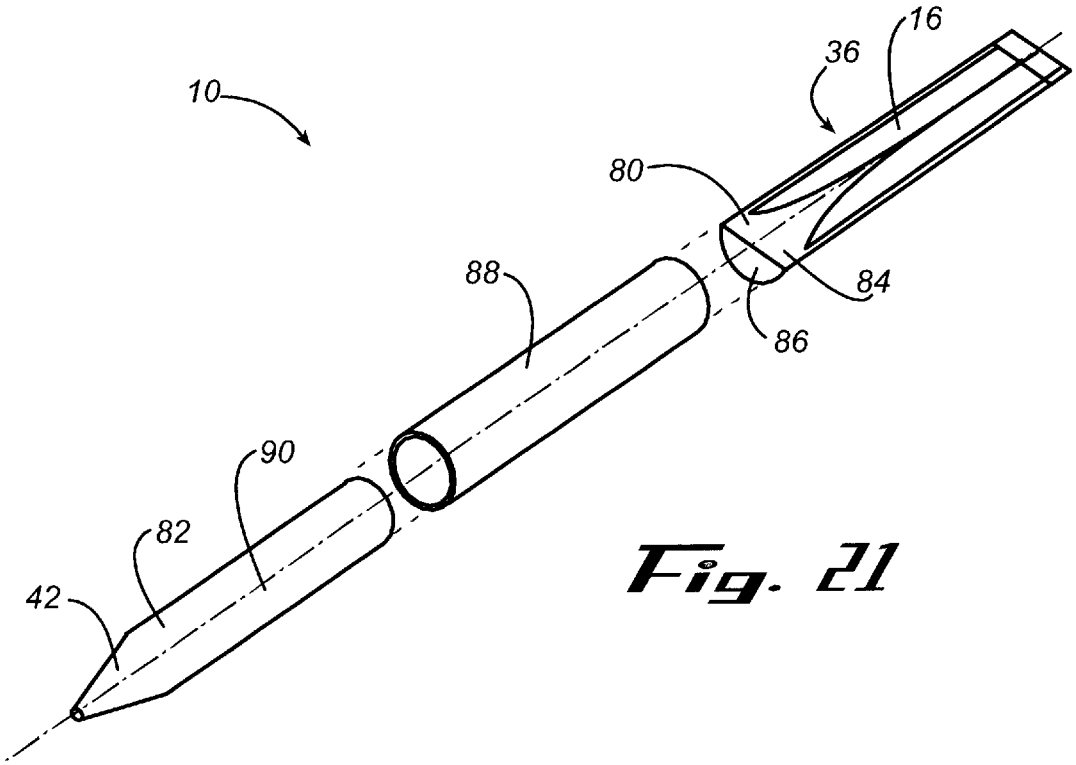
FIG. 21 is a partially-exploded, perspective view of a preferred embodiment of the present invention showing a preferred method of manufacture.

As shown in FIG. 21, a preferred embodiment of the transition 10 of the present invention may incorporate a first dielectric material member 80 and a second dielectric material member 82 which are adapted for receiving element feed 16 therebetween. Preferably, the first dielectric material member is configured as a substantially half cylinder with a planar surface 84 configured to engage the element feed and an arcuate surface 86 configured to engage a portion of the interior of the waveguide housing 88. Additionally, the second dielectric material member 82 may incorporate a substantially half-cylinder shape which is adapted to mate with an opposing surface of the element feed, thereby preferably orienting the element feed along the longitudinal axis 90 of the housing when the first and second members are so mated and then disposed at least partially within the housing. As depicted in FIG. 21, for those embodiments incorporating a radiator 42, the radiator may be configured as an extension of either of the first and second members.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of the present invention.

What is claimed is:

1. An antenna for transmitting and receiving electromagnetic energy, said antenna comprising:

a longitudinally extending housing having a first end and a second end, and defining an interior therebetween;

a dielectric material configured with a slot therein and disposed at least partially within said interior of said longitudinally extending housing such that said longitudinally extending housing and said dielectric material form a dielectric-filled waveguide; and an element feed disposed at least partially within said interior of said longitudinally extending housing and surrounded at least partially by said dielectric material, comprising:

a first transition from a first section of a microstrip transmission line not disposed within said housing to a pseudo-stripline transmission line, wherein said pseudo-stripline transmission line comprises a second section of said microstrip transmission line disposed within a first section of said housing that is not filled with said dielectric material;

a second transition from said pseudo-stripline transmission line to a pseudo-slotline transmission line, wherein said pseudo-slotline transmission line comprises a third section of said microstrip transmission line disposed within a second section of said housing that is filled with said dielectric material; and a third transition from said pseudo-slotline transmission line to a first and a second opposing flare extending from said pseudo-slotline transmission line to within said interior of said longitudinally extending housing, wherein said element feed is configured to transfer electromagnetic energy between said antenna and a transmission line.

2. The antenna of claim 1, further comprising a radiator communicating with said dielectric material.

3. The antenna of claim 1, further comprising a transmit/receive module electrically communicating with said microstrip transmission line.

4. An antenna array for transmitting and receiving electromagnetic energy comprising:

a base; and a plurality of antennas mounted to said base, each of said plurality of antennas having:

a longitudinally extending housing having a first end and a second end, and defining an interior therebetween;

a dielectric material disposed at least partially within said interior of said longitudinally extending housing such that said longitudinally extending housing and said dielectric material form a dielectric-filled waveguide; and an element feed disposed at least partially within said interior of said longitudinally extending housing and surrounded at least partially by said dielectric material, comprising:

a first transition from a first section of a microstrip transmission line not disposed within said housing to a pseudo-stripline transmission line, wherein said pseudo-stripline transmission line comprises a second section of said microstrip transmission line disposed within a first section of said housing that is not filled with said dielectric material;

a second transition from said pseudo-stripline transmission line to a pseudo-slotline transmission line, wherein said pseudo-slotline transmission line comprises a third section of said microstrip transmission line disposed within a second section of said housing that is filled with said dielectric material; and a third transition from said pseudo-slotline transmission line to a first and a second opposing flare extending from said pseudo-slotline transmission line to within said interior of said longitudinally extending housing, wherein said element feed is configured to transfer electromagnetic energy between said antenna and a transmission line.

5. The antenna array of claim 4, wherein said longitudinally extending housing is cylindrically shaped.

6. The antenna array of claim 4, wherein said first and second opposing flares are configured such that the impedance of said third transition varies at a constant rate of change of impedance per unit length of said flares.

7. The antenna array of claim 4, wherein said element feed has means for transmitting electromagnetic energy between said pseudo-slotline transmission line and said dielectric material.

8. A method of forming a dielectric-filled waveguide comprising the steps of:

providing a longitudinally extending housing having a longitudinal axis and defining an interior;

providing a first dielectric material member;

providing a second dielectric material member;

arranging said first dielectric material member and said second dielectric material at least partially within the interior of said housing such that said longitudinally extending housing and said dielectric material members form a dielectric-filled waveguide; and providing an element feed, comprising:

a first transition from a first section of a microstrip transmission line not disposed within said housing to a pseudo-stripline transmission line, wherein said pseudo-stripline transmission line comprises a second section of said microstrip transmission line disposed within a first section of said housing that does not contain said first and second dielectric material members;

a second transition from said pseudo-stripline transmission line to a pseudo-slotline transmission line, wherein said pseudo-slotline transmission line comprises a third section of said microstrip transmission line disposed between said first and second dielectric material members arranged within said housing; and a third transition from said pseudo-slotline transmission line to a first and a second opposing flare extending from said pseudo-slotline transmission line to within said interior of said longitudinally extending housing, said element feed being arranged along the longitudinal axis of said housing.

9. The method of claim 8, wherein the step of providing a first dielectric material member comprises forming the first dielectric material member as a half cylinder, the half cylinder having a planar surface configured to engage the element feed and an accurate surface configured to engage a portion of the interior of the housing.

10. An electromagnetic transition for transferring electromagnetic energy between two types of transmission lines, said electromagnetic transition comprising:

a longitudinally extending housing having a first end, a second end, and electrically conducting walls, and defining an interior therebetween;

a dielectric material disposed at least partially within said interior of said longitudinally extending housing such that said longitudinally extending housing and said dielectric material form a dielectric-filled waveguide; and an element feed disposed at least partially within said interior of said longitudinally extending housing and surrounded at least partially by said dielectric material, comprising:

a first transition from a first section of a microstrip transmission line not disposed within said housing to a pseudo-stripline transmission line, wherein said pseudo-stripline transmission line comprises a second section of said microstrip transmission line disposed within a first section of said housing that is not filled with said dielectric material;

a second transition from said pseudo-stripline transmission line to a pseudo-slotline transmission line, wherein said pseudo-slotline transmission line comprises a third section of said microstrip transmission line disposed within a second section of said housing that is filled with said dielectric material; and a third transition from said pseudo-slotline transmission line to a first and a second opposing flare extending from said pseudo-slotline transmission line to within said longitudinally extending housing, wherein said electromagnetic transition is configured to transfer electromagnetic energy between said microstrip transmission line and said dielectric-filled waveguide.

11. The system of claim 10, wherein:

said dielectric material is further configured with a slot therein; and said element feed is further configured as a printed circuit card partially insertable within said slot of said dielectric material to provide said first, second, and third transitions.

12. A method for transferring electromagnetic-energy between two types of transmission lines, said method comprising the steps of:

providing a waveguide comprised of a longitudinally extending housing at least partially filled with a dielectric material; and providing an element feed at least partially disposed within said waveguide, wherein said element feed comprises:

a first transition from a first section of a microstrip transmission line not disposed within said housing to a pseudo-stripline transmission line, wherein said pseudo-stripline transmission line comprises a second section of said microstrip transmission line disposed within a first section of said housing that is not filled with said dielectric material;

a second transition from said pseudo-stripline transmission line to a pseudo-slotline transmission line, wherein said pseudo-slotline transmission line comprises a third section of said microstrip transmission line disposed within a second section of said housing that is filled with said dielectric material; and a third transition from said pseudo-slotline transmission line to a first and a second opposing flare extending from said pseudo-slotline transmission line to within said longitudinally extending housing.

13. The method of claim 12, wherein:

said step of providing a waveguide further comprises configuring a slot within said dielectric material disposed within said longitudinally extending housing; and said step of providing an element feed further comprises configuring said element feed as a printed circuit card partially insertable within said slot of said dielectric material to provide said first, second, and third transitions.

* * * * *